US007544089B2

(12) United States Patent
Liu et al.

(10) Patent No.: US 7,544,089 B2
(45) Date of Patent: Jun. 9, 2009

(54) ADAPTER FOR USB AND AUDIO INTERFACE

(75) Inventors: Chang-Chun Liu, Shenzhen (CN); Xiao-Lin Gan, Shenzhen (CN); Yu-Kuang Ho, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 15 days.

(21) Appl. No.: 11/953,877

(22) Filed: Dec. 11, 2007

(65) Prior Publication Data

US 2009/0104799 A1 Apr. 23, 2009

(30) Foreign Application Priority Data

Oct. 22, 2007 (CN) ..... 2007 1 0202202

(51) Int. Cl.
*H01R 11/00* (2006.01)

(52) U.S. Cl. ..... 439/502

(58) Field of Classification Search ..... 439/502, 439/620, 638, 660, 620.24, 620.17; 702/120
See application file for complete search history.

(56) References Cited

U.S. PATENT DOCUMENTS

| | | | | |
|---|---|---|---|---|
| 6,663,420 | B1 * | 12/2003 | Xiao | 439/502 |
| 6,746,273 | B1 * | 6/2004 | Liu et al. | 439/502 |
| 6,813,662 | B2 * | 11/2004 | Park | 710/74 |
| 2004/0102917 | A1 * | 5/2004 | Chen et al. | |
| 2006/0154530 | A1 * | 7/2006 | Novotney et al. | 439/660 |
| 2007/0047745 | A1 * | 3/2007 | Lai et al. | 381/123 |

* cited by examiner

*Primary Examiner*—Jean F Duverne
(74) *Attorney, Agent, or Firm*—Frank R. Niranjan

(57) ABSTRACT

An adapter includes a first USB interface, a second USB interface, and an audio interface. The first and the second USB interfaces each have a power pin, a first data pin, a second data pin, and a ground pin. The pins of the first USB interface respectively connected to the pins of the second USB interface correspondingly. The audio interface includes a left ear audio pin, a right ear audio pin, and a ground pin. The left ear audio pin of the audio interface is connected to the first data pin of the second USB interface. The right ear audio pin of the audio interface is connected to the second data pin of the second USB interface.

5 Claims, 2 Drawing Sheets

ADAPTER FOR USB AND AUDIO INTERFACE

BACKGROUND

1. Field of the Invention

The present invention relates to adapters, and particularly to an adapter which can accommodate two universal serial bus (USB) interfaces and an audio interface.

2. Description of Related Art

Nowadays, different types of USB interface devices, such as standard USB interfaces and mini-USB interfaces are used in many fields. Thereby, some USB adapters are designed to adapt a device to accommodate these different types of USB interfaces.

The mini-USB interface not only can transmit data signals but also can transmit audio signals. Therefore, some adapters are designed to adapt the audio USB interface to other types of audio interfaces such as 2.5 mm/3.5 mm audio interface. However, there are no adapters for both accommodating different types of USB interfaces but also adapting the audio USB interface to other types of audio interfaces.

What is needed is to provide an adapter which can accommodate different types of USB interfaces and adapt audio USB interface to other types of audio interfaces.

SUMMARY

An embodiment of an adapter includes a first USB interface, a second USB interface, and an audio interface. The first and second USB interfaces each have a power pin, a first data pin, a second data pin, and a ground pin. The pins of the first USB interface respectively connected to the pins of the second USB interface correspondingly. The audio interface includes a left ear audio pin, a right ear audio pin, and a ground pin. The left ear audio pin of the audio interface is connected to the first data pin of the second USB interface. The right ear audio pin of the audio interface is connected to the second data pin of the second USB interface.

Other advantages and novel features of the present invention will become more apparent from the following detailed description of an embodiment when taken in conjunction with the accompanying drawings, in which:

DETAILED DESCRIPTION

Figure 1:
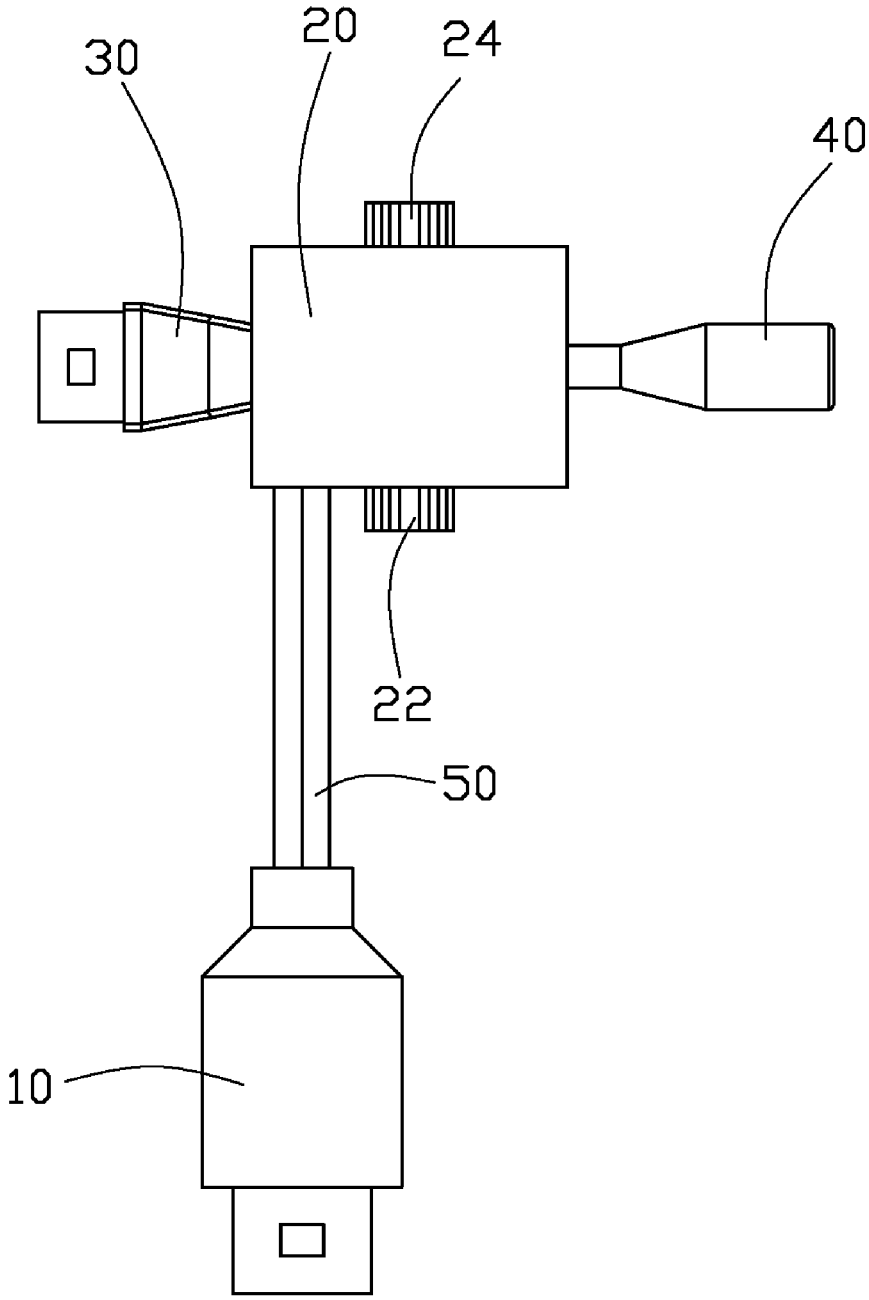
FIG. 1 is a top plan view of an adapter in accordance with an embodiment of the present invention.
Figure 2:
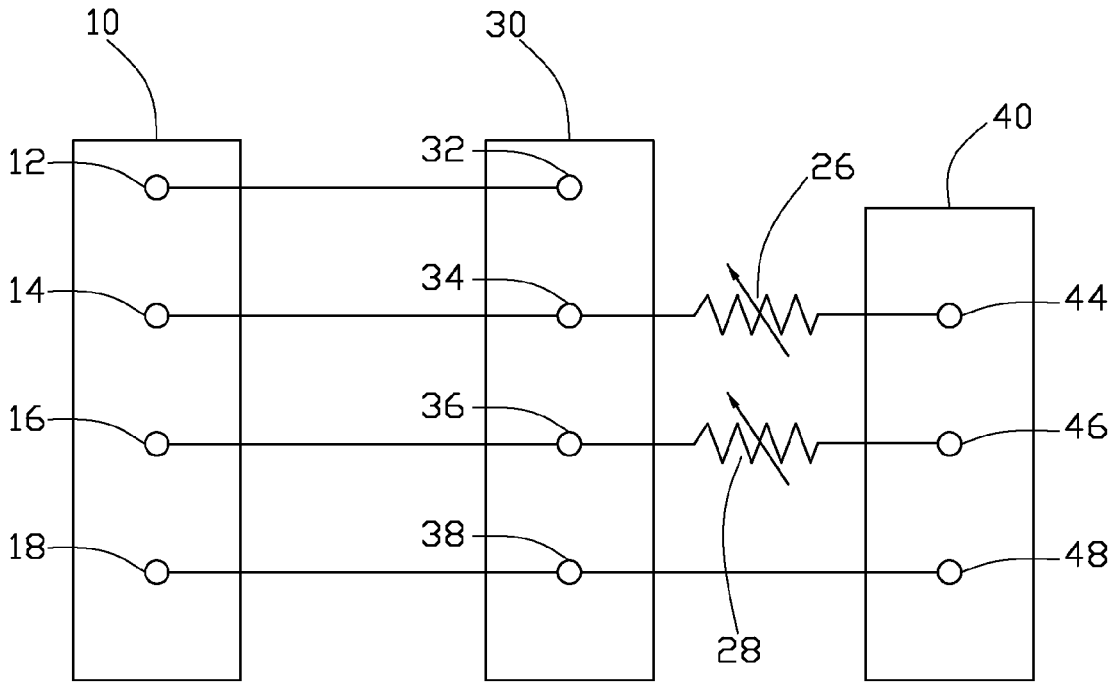
FIG. 2 is a circuit diagram of the adapter of FIG. 1.

Referring to FIGS. 1 and 2, an adapter in accordance with an embodiment of the present invention includes a first USB interface 10, a main body 20, a second USB interface 30, an audio interface 40, a first knob 22, a second knob 24, a first variable resistor 26, and a second variable resistor 28. In this embodiment, the first USB interface 10 is a standard USB interface. The second audio interface 30 is a mini-USB interface. The audio interface 40 is a 3.5 mm audio interface. The first USB interface 10 and second USB interface 30 can be designed as other types of USB interfaces according to need, and the audio interface 40 can also be designed as other types of audio interfaces according to need.

The first USB interface 10 is connected to the main body 20 via a data cable 50. The second USB interface 30 and audio interface 40 are respectively mounted on opposite ends of the main body 20. The first knob 22 and second knob 24 are respectively mounted on opposite sides of the main body 20. The first variable resistor 26 and second variable resistor 28 are installed in the main body 20. The first knob 22 is connected to an adjusting terminal of the first variable resistor 26 to adjust the resistance of the first variable resistor 26. The second knob 24 is connected to an adjusting terminal of the second variable resistor 28 to adjust the resistance of the second variable resistor 28.

The first USB interface 10 includes a power pin 12, a first data pin 14, a second data pin 16, and a ground pin 18. The second audio interface 30 includes a power pin 32, a first data pin 34, a second data pin 36, and a ground pin 38. The pins of the first USB interface 10 are respectively connected to the pins of the second USB interface 30 via the data cable 50 correspondingly.

The second USB interface 30 can be used as an audio USB interface, and the first data pin 14 and second data pin 16 can be respectively used as an left ear audio pin and a right ear audio pin. The audio interface 40 includes a left ear audio pin 44, a right ear audio pin 46, and a ground pin 48. The first data pin 34 (namely left ear audio pin) of the second USB interface 30 is connected to the left ear audio pin 44 of the audio interface 40 via the first variable resistor 26. The second data pin 36 (namely right ear audio pin) of the second USB interface 30 is connected to the right ear audio pin 46 of the audio interface 40 via the second variable resistor 28. The ground pin 38 of the second USB interface 30 is connected to the ground pin 48 of the audio interface 40. In other embodiments, the first knob 22, second knob 24, first variable resistor 26, and second variable resistor 28 can be deleted as a cost saving measure.

When the adapter is used to adapt the first USB interface 10 to the second USB interface 30, the first USB interface 10 is connected to a corresponding electronic device, and the second USB interface 30 is connected to a corresponding electronic device. Thus, the two electronic devices can communicate with each other via the adapter.

When the adapter is used to adapt the second USB interface 30 to the audio interface 40, an audio interface of an earphone set is connected to the audio interface 40. An audio USB interface of an audio device, such as a mobile telephone, is connected to the second USB interface 30. When the audio device transmits an audio signal, the earphone set will receive the audio signal from the audio device. Moreover, if two users use the earphone set at the same time, and each want to use an earphone of the earphone set, they can adjust volume respectively via the first knob 24 and the second knob 28, which is very convenient.

The adapter of the present invention not only can accommodate different types of USB interfaces but can also adapt the audio USB interface to other types of audio interfaces, which is very convenient.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An adapter comprising:

a first universal serial bus (USB) interface having a power pin, a first data pin, a second data pin, and a ground pin;

a second USB interface having a power pin, a first data pin, a second data pin, and a ground pin, the pins of the first USB interface respectively connected to the pins of the second USB interface correspondingly, wherein the types of the first and second USB interfaces are different; and an audio interface having a left ear audio pin, a right ear audio pin, and a ground pin, the left ear audio pin of the audio interface connected to the first data pin of the second USB interface, the right ear audio pin of the audio interface connected to the second data pin of the second USB interface;

wherein the first and second USB interfaces are capable of connecting between two corresponding electronic devices respectively for communicating the two electronic devices; the second USB interface and the audio interface are capable of connecting between two corresponding audio devices respectively for transmitting audio signals between the two audio devices, wherein a first variable resistor is connected between the left ear audio pin of the audio interface and the first data pin of the second USB interface, a second variable resistor is connected between the right ear audio pin of the audio interface and the second data pin of the second USB interface.

2. The adapter as claimed in claim 1, wherein the first variable resistor and the second variable resistor are installed in a main body having a first knob and a second knob mounted thereon, the first knob is connected to an adjusting terminal of the first variable resistor to adjust the resistance thereof, the second knob is connected to an adjusting terminal of the second variable resistor to adjust the resistance thereof.

3. The adapter as claimed in claim 2, wherein the first USB interface is connected to the main body via a data cable, the audio interface and the second USB interface are respectively mounted on opposite ends of the main body, the first knob and the second knob are respectively mounted on opposite sides of the main body.

4. The adapter as claimed in claim 1, wherein the first USB interface is a standard USB interface, the second USB interface is a mini-USB interface, and the audio interface is a 3.5 mm audio interface.

5. An adapter comprising:

a first universal serial bus (USB) interface having a power pin, a first data pin, a second data pin, and a ground pin;

a second USB interface having a power pin, a first data pin, a second data pin, and a ground pin, the pins of the first USB interface respectively connected to the pins of the second USB interface correspondingly; and an audio interface having a left ear audio pin, a right ear audio pin, and a ground pin, the left ear audio pin of the audio interface connected to the first data pin of the second USB interface, the right ear audio pin of the audio interface connected to the second data pin of the second USB interface;

wherein a first variable resistor is connected between the left ear audio pin of the audio interface and the first data pin of the second USB interface, a second variable resistor is connected between the right ear audio pin of the audio interface and the second data pin of the second USB interface; the first variable resistor and the second variable resistor are installed in a main body having a first knob and a second knob mounted thereon, the first knob is connected to an adjusting terminal of the first variable resistor to adjust the resistance thereof, the second knob is connected to an adjusting terminal of the second variable resistor to adjust the resistance thereof.

* * * * *